US007320150B2

(12) United States Patent
Stewart

(10) Patent No.: US 7,320,150 B2
(45) Date of Patent: Jan. 22, 2008

(54) AUTOMATIC DUST PAN BROOM

(76) Inventor: Pierre Stewart, 2625 Chateauguay, app. 101, Montreal, Quebec (CA) H3K 3KI ( * ) Notice: Subject to any disclaimer, the term of this patent is extended or adjusted under 35 U.S.C. 154(b) by 400 days.

(21) Appl. No.: 10/890,835

(22) Filed: Jul. 14, 2004

(65) Prior Publication Data

US 2005/0015919 A1 Jan. 27, 2005

(51) Int. Cl.
*A47L 9/02* (2006.01)

(52) U.S. Cl. ..... 15/344; 15/350; 15/398; 15/410

(58) Field of Classification Search ..... None
See application file for complete search history.

(56) References Cited

U.S. PATENT DOCUMENTS 2,806,242 A * 9/1957 Sparklin ..... 15/351
4,972,541 A * 11/1990 Smith, Jr. ..... 15/105
5,839,158 A * 11/1998 Schupp et al. ..... 15/350
6,125,500 A * 10/2000 Kat ..... 15/344

FOREIGN PATENT DOCUMENTS

CA 2087056 * 1/1993
DE 19857685 * 6/2000

* cited by examiner

*Primary Examiner*—David Redding

(57) ABSTRACT

A broom (20) which permits picking up dust and disposing of said dust while standing up. The broom (20) comprises an aspiration canal (24) in the broom brush (22), reaching an aspiration tubing situated inside the broom handle (26). The aspiration tubing is ended by a removable cap (28). A motor (34) is situated alongside the tubing and permits the aspiration of air through the aspiration canal and aspiration tubing by an opening (32) along the tubing side. The opening is made of a semi permeable membrane (38) which allows air to exit the tube while keeping dust inside. The broom inside tubing comprises means to keep the dust inside the tubing, so the dust does not fall out through the bottom of the tubing. After the broom operator has finished aspiring the dust inside the broom handle, he may remove the cap, turn the broom upside down, and empty the dust into. All this without bending down.

7 Claims, 2 Drawing Sheets

AUTOMATIC DUST PAN BROOM

FIELD OF THE INVENTION

This invention belongs to the field of vacuum cleaner/broom hybrids. Particularly to a broom that comprises vacuum means to aspire dust and means to empty the dust while with no need of bending down to do so.

DESCRIPTION OF THE PRIOR ART

In order to pick up the dust collected with usual brooms, it is necessary to bend down and push the dust in a dust pan with the broom. The following patents describe brooms which combine sweeping and aspiration. U.S. Pat. No. 6,125,500, Kat, Oct. 3rd 2000, describes a broom which is combined to a vacuum cleaner in a way that the broom gathers the dust in a pile, and that the vacuum cleaner picks up the dust.

U.S. Pat. No. 5,839,158, Schupp, Nov. 24th 1998, stores dust in a compartment situated near the broom brush.

DE 19857685, Dabelstein, Jun. 15th 2000, shows a vacuum localized close to the brush.

CA 2087056, Walsh, Jan. 11th 1993, shows a vacuum fitted in the superior part of the broom handle, but does not offer means to keep the dust inside the handle.

BACKGROUND OF THE INVENTION

It is common to many elders and to people with physical disabilities to have difficulty bending down to pick up the dust pile left over from sweeping the floors. The general objective of this invention is to provide a broom which comprises means to pick up the dust pile up without a need for bending down. Additionally, it is important that a device accomplishing this objective does so while keeping some important "normal broom" attributes, such as: a light weight body, and easy maneuverability.

SUMMARY OF THE INVENTION

In order to do so, I have created a broom handle that contains means to retain dust particles. I have fitted this broom handle to a brush containing an opening, in the way that dust may enter the handle by the bottom. I have also assembled the broom handle to aspiration means. The aspiration means permit to create an airstreams which picks up dust particles from the bottom of the broom, as with a normal vacuum cleaner. These dust particles are then imprisoned inside the broom handle due to the dust retaining means, and are kept from the aspiration means by the action of gravity, and a semi-permeable membrane that lets air through but keeps dust inside the handle.

The broom handle has an opening at the top which is kept closed by a cap. When the handle is full, or when the sweeping is finished, one may remove the cap and turn the broom upside-down, so the dust may exit the handle by the top, or activate a release mechanism which permits the dust to exit by the bottom.

Hence, it is possible to complete the entire sweeping procedure while standing up, with no need to bend down.

DESCRIPTION OF THE DRAWINGS

The drawings illustrate embodiments of the invention.

DETAILED DESCRIPTION OF THE DRAWINGS

Figure 2:
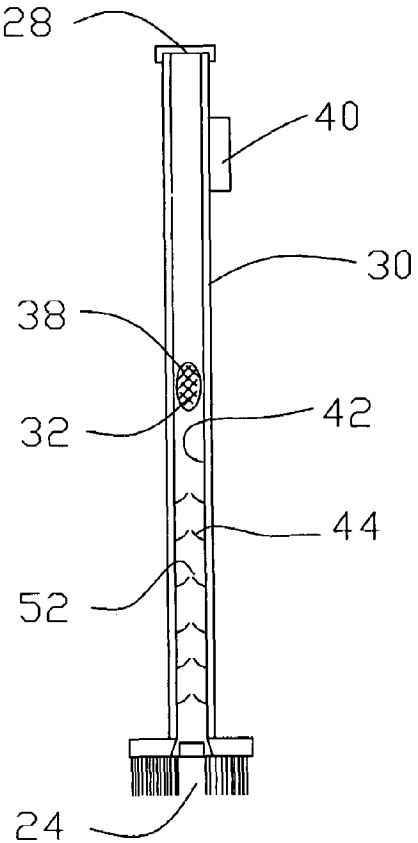
FIG. 2 is a sectional view along line 2-2 of FIG. 1.

In the following description the bold numbers refer to items illustrated in the drawings.

Figure 1:
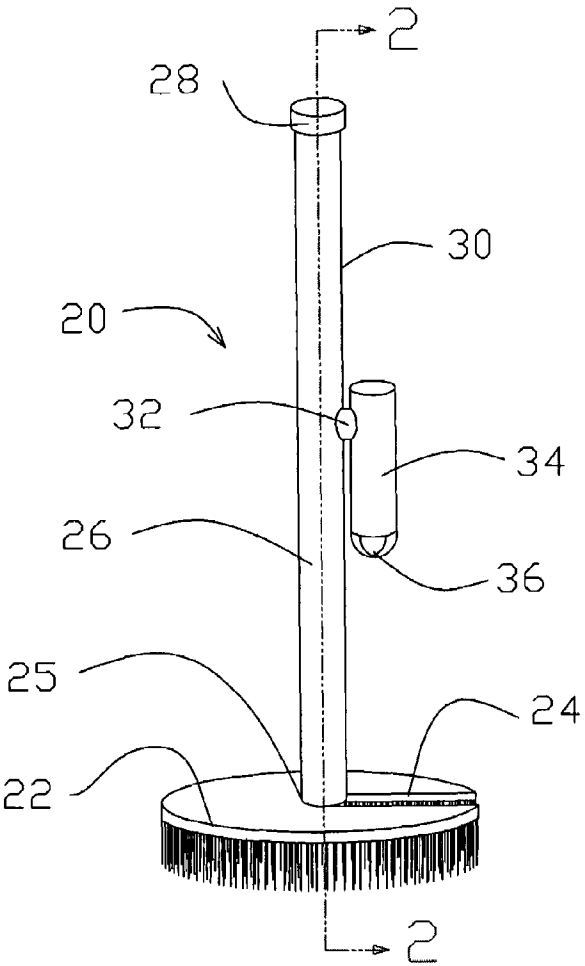
FIG. 1 is a front and upward perspective view of a broom.

FIG. 1 illustrates an automatic dust pan broom 20. Towards the bottom of the broom, there is a brush 22 comprising an aspiration channel 24. An aspiration tube 26 reaches the brush at a junction point 25. The aspiration channel is a hollow broom handle. A cap 28 removable closes the aspiration channel top opening. The aspiration tube is a cylindrical wall 30 which has a lateral opening 32 reaching an aspiration chamber 34. The aspiration chamber comprises aspiration means, and an air exhaust 36.

FIG. 2 shows a sectional view along line 2-2 of FIG. 1. We can see the inside of the broom. At the bottom, we can see that the broom has an opening 24 through which dust may be aspired. Also visible is the activation button 40 through which one may trigger the aspiration. Inside the tube, an opening 32 is fitted with a semi-permeable membrane 38. In this application, the means to imprison dust are dust collectors 44 which are set against the internal face 42 of the broom handle. The dust collectors keep the dust particles from falling down and out of the opening by the attraction of gravity. When in operation, the dust particles flow up the tubing with the airflow generated by the aspiration means. The airflow leads to the lateral opening 32. Some dust particles fall down and are kept by the dust collectors. Some dust particles may continue going up pass the airstreams because of their inertia, they may be collected by additional dust collectors. The dust collectors may be made of a flexible material so they fold up while the broom is aspiring, and fold back down when the aspiration stops to collect dust particles. There may be only one dust collector, or many as illustrated. In addition to the means described above, the dust collector may also be a one-way valve which lets dusty air in but closes to keep the dust from flowing out once the aspiration action is finished. The air containing dust flows up through the central channel 52 in this application.

Figure 3:
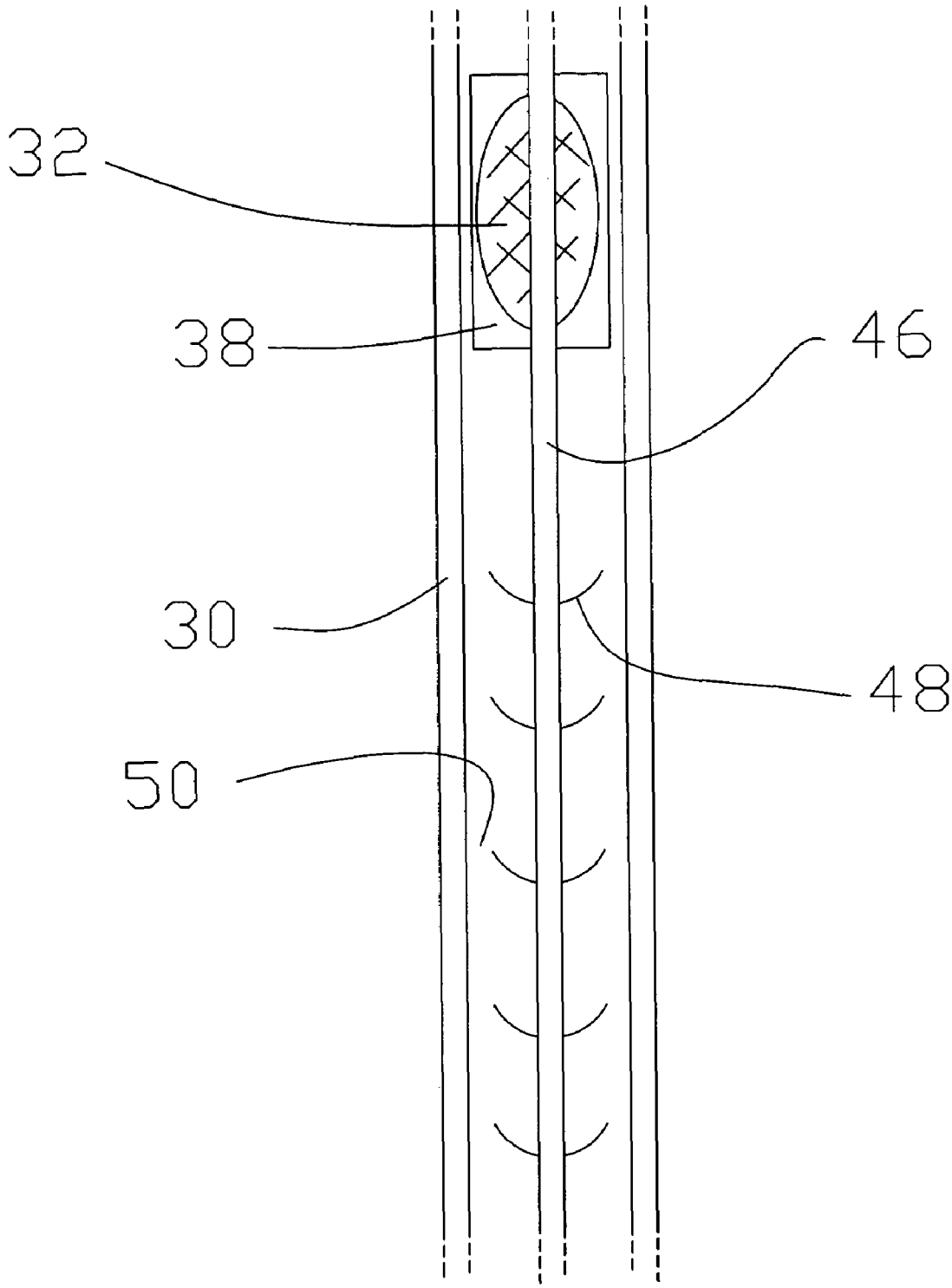
FIG. 3 is a sectional view of an alternative to the configuration of FIG. 2.

FIG. 3 shows another application of the invention. In this application, the dust collectors 48 are installed upon a central rod 46. The dusty air flows externally to the rod in an external channel 50. The advantage of using this configuration is that the external channel will generally let much more air pass than a small central channel. This image is enlarged compared to FIG. 2, so we may see the lateral opening 32, and the semi permeable membrane 38 more clearly.

CONSTRUCTION DETAILS

The external tubing wall 30 may be made of aluminum, or another light material in order to decrease the overall weight of the automatic dust pan broom. At the bottom of the handle, towards the junction point 25 certain applications of the invention may use an extension to aspire a greater quantity of dust from the floor.

The aspiration means usually consist of a motor and a fan, as in a vacuum cleaner. In this case, it will be interesting to use a lightweight battery for power. By using a battery, there will be no need for an extension cord, which means better maneuverability.

Instead, it may prove useful to use a pneumatic system. For example, we may use a container which either empty of air, which would aspire dust when it fills up, or use an aspiration system which is driven by compressed air. The compressed air container may then be filled again by the use of a compressor.

In use, it will prove helpful to use dust collectors which permit collection of a large quantity of dust before emptying the handle.

SUMMARY

Generally, I conceived a broom that acts as a vacuum at its base. A mechanism producing a vacuum permitting the aspiration and the temporary storage of dust inside a tube, after sweeping in a comfortable, easy and light way. The vacuum end can be flexible, allowing to bend the broom lightly to orientate the end towards the dust. Storing the dust in the handle maximizes the use of the handle volume while holding the broom. The dust is kept inside in a lobster trap type device. Ideally, the activation of the vacuum mechanism could be done by a soft touch on a button preferably localized towards the top of the handle, near the hand of the operator. After using, the cap of the tube is unscrewed and the whole broom is turned upside down to empty into the garbage.

Concise Summary of the Invention

A broom 20 permitting the storage and the collection of the dust by a person in an upright position, the broom comprising in combination:

a brush 22, an aspiration tubing 26 comprising at a lower end, a junction point 25 to the brush, the tube comprising also a wall 30, that has an exit 32 localized between 60 et 90% of its height and at a higher end, near cap 28; the junction point comprising the aspiration channel 24 meant to allow the passage of dust from the brush unto the tube, an aspiration chamber 34 disposed along and out of the exit 32 and comprising aspiration means through the exit, means of air exhaust 36 and means for attaching the tube, a semi permeable membrane 38 mounted to cover the opening and meant to retain the dust in the tube, the action of the aspiration means through the membrane and the exit causing the passage of the tube air toward the aspiration chamber through the exhaust while retaining the dust in the tube. The removing of the cap and the manner of turning the apparatus upside down to evacuate the dust from the tube.

The brush includes a horizontal support and vertical bristles while the opening means comprise a slit in the support prolonged until the junction point 25.

In an application, the wall 30 comprises external dust collectors 44 meant to retain a certain quantity of dust along the wall.

In another application, inside the wall 30 stands a rod 46 localized in the interior of the tube, the rod comprising central dust collectors 48 meant to retain a deposit of dust along the rod.

With respect to the above description, it is to be realized that the optimum dimensional relationships for the parts of the invention, to include variations in size, materials, and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

LEGEND

20—Broom
22—Brush
24—Aspiration channel
25—Junction point
26—Aspiration tubing
28—Cap
30—External wall
32—Lateral opening
34—Aspiration chamber
36—Air exhaust
38—Membrane
40—Activation button
42—Internal face of wall
44—External dust collectors
46—Rod
48—Central dust collectors
50—Circumferential channel
52—Central channel

I claim:

1. A broom (20) which permits dust collection and disposal by an operator which remains standing up, said broom comprising: a hollow aspiration tubing (26) consisting of a cylindrical wall (30) comprising a lower opening (25) and an upper opening (28), a brush (22) situated towards the lower end (24) which comprises an opening corresponding to said lower opening, to permit the flowing of air to the inside of said aspiration tubing, a removable cap (28) to open and close said upper opening, air aspiration means that may be activated to cause an airflow from said lower opening up inside the aspiration tubing, and out of the aspiration tubing, said aspiration means being localized outside of said aspiration tubing and comprising means to keep dust particles inside said tubing while air flows out, retention means to keep dust particles inside said aspiration tubing when said aspiration ceases, said retention means permitting said dust particles to flow out by said upper opening when said cap is removed and said broom is turned upside-down, wherein said retention means consist of a number of dust collectors consisting of discs which are installed along said wall thus leaving a central channel for air and dust circulation.

2. A broom (20) which permits dust collection and disposal by an operator which remains standing up, said broom comprising: a hollow aspiration tubing (26) consisting of a cylindrical wall (30) comprising a lower opening (25) and an upper opening (28), a brush (22) situated towards the lower end (24) which comprises an opening corresponding to said lower opening, to permit the flowing of air to the inside of said aspiration tubing, a removable cap (28) to open and close said upper opening, air aspiration means that may be activated to cause an airflow from said lower opening up inside the aspiration tubing, and out of the aspiration tubing, said aspiration means being localized outside of said aspiration tubing and comprising means to keep dust particles inside said tubing while air flows out, retention means to keep dust particles inside said aspiration tubing when said aspiration ceases, said retention means permitting said dust particles to flow out by said upper opening when said can is removed and said broom is turned upside-down, said cylindrical wall (30) further comprising a central rod inside said aspiration tubing, and wherein said retention means consist of a number of dust collectors consisting of discs extending outwardly from said rod thus leaving an external channel for air and dust circulation.

3. The broom of claims 1 or 2 wherein said brush consists of a horizontal support holding vertical strands extending downwardly from said support, and wherein said vertical support comprises an opening extending from one side of said support to said lower opening.

4. A broom (20) which permits dust collection and disposal by an operator which remains standing up, said broom comprising: a hollow aspiration tubing (26) consisting of a cylindrical wall (30) comprising a lower opening (25) and an upper opening (28), a brush (22) situated towards the lower end (24) which comprises an opening corresponding to said lower opening, to permit the flowing of air to the inside of said aspiration tubing a removable cap (28) to open and close said upper opening, air aspiration means that may be activated to cause an airflow from said lower opening up inside the aspiration tubing, and out of the aspiration tubing, said aspiration means being localized outside of said aspiration tubing and comprising means to keep dust particles inside said tubing while air flows out, retention means to keep dust particles inside said aspiration tubing when said aspiration ceases, said retention means permitting said dust particles to flow out by said upper opening when said cap is removed and said broom is turned upside-down, said cylindrical wall comprising a lateral opening and said means to keep dust in comprising a semi permeable membrane covering said lateral opening, said aspiration means comprising an air exhaust, disposed against said lateral opening in order to aspire air from said aspiration tubing, through said semi permeable membrane and to said air exhaust.

5. The broom of claim 4 wherein said semi permeable membrane is made of a filtering material.

6. The broom of claim 4 wherein said lateral opening is situated at least at ⅝ of the total distance between said lower and upper openings.

7. The broom of claim 4 wherein said lateral opening is situated within 66% to 90% of the total distance between said lower and upper openings.

* * * * *